US007913680B2

(12) United States Patent
Evans

(10) Patent No.: US 7,913,680 B2
(45) Date of Patent: Mar. 29, 2011

(54) PORTABLE BOW PRESS AND LIMB CONNECTOR THEREFOR

(75) Inventor: John D. Evans, Calgary (CA)

(73) Assignee: Evco Technology & Development Company, Ltd., Calgary, Alberta (CA)

( * ) Notice: Subject to any disclaimer, the term of this patent is extended or adjusted under 35 U.S.C. 154(b) by 219 days.

(21) Appl. No.: 12/127,604

(22) Filed: May 27, 2008

(65) Prior Publication Data

US 2009/0293854 A1 Dec. 3, 2009

(51) Int. Cl.
*F41B 5/00* (2006.01)

(52) U.S. Cl. ..... 124/86; 124/1; 124/23.1; 124/25.6; 124/80; 124/88

(58) Field of Classification Search ..... 124/1, 23.1, 124/25.6, 80, 86, 88
See application file for complete search history.

(56) References Cited

U.S. PATENT DOCUMENTS

| | | | | |
|---|---|---|---|---|
| 4,291,452 | A * | 9/1981 | Whitman et al. | 29/235 |
| 4,599,987 | A * | 7/1986 | Rezmer | 124/23.1 |
| 5,022,377 | A * | 6/1991 | Stevens | 124/23.1 |
| 5,125,389 | A * | 6/1992 | Paff | 124/86 |
| 5,222,473 | A * | 6/1993 | Lint | 124/86 |
| 5,370,103 | A * | 12/1994 | Desselle | 124/86 |
| 5,425,350 | A * | 6/1995 | Egusquiza | 124/86 |
| 5,433,186 | A * | 7/1995 | Corwin | 124/86 |
| 5,746,192 | A * | 5/1998 | Gissel | 124/1 |
| 5,957,120 | A * | 9/1999 | Wiseby et al. | 124/86 |
| 6,386,190 | B1 * | 5/2002 | Kurtz, Jr. | 124/1 |
| 6,957,647 | B2 * | 10/2005 | Evans et al. | 124/86 |
| 6,968,834 | B1 * | 11/2005 | Gibbs | 124/1 |
| 7,089,923 | B2 * | 8/2006 | Johnson | 124/1 |
| 7,185,644 | B2 * | 3/2007 | Kurtz, Jr. | 124/1 |
| 7,255,099 | B2 * | 8/2007 | Henry | 124/1 |
| 7,311,095 | B2 * | 12/2007 | Bauder | 124/1 |
| 7,637,256 | B2 * | 12/2009 | Lee | 124/25.6 |
| 7,644,708 | B2 * | 1/2010 | Pittman | 124/1 |
| 2004/0129260 | A1 * | 7/2004 | Evans et al. | 124/1 |
| 2004/0194770 | A1 * | 10/2004 | Johnson | 124/1 |
| 2006/0000462 | A1 * | 1/2006 | Kurtz | 124/1 |
| 2007/0079818 | A1 * | 4/2007 | Bauder | 124/1 |
| 2007/0119438 | A1 * | 5/2007 | Pittman | 124/1 |
| 2009/0032004 | A1 * | 2/2009 | Jones | 124/86 |
| 2009/0056688 | A1 * | 3/2009 | Marsh et al. | 124/1 |

OTHER PUBLICATIONS

Bill Krenz, Ram Products Ratchet-Loc Bow Press & Pro Bow Vise, Field Test, Market Trends, Inside Archery, Feb. 2007, p. 74-75.

Night Hawk Archery, A new way of pressing your bow, www.nighthawkarchery.com/My_Homepage_files/Page4.html, Apr. 14, 2008, p. 1-4.

* cited by examiner

*Primary Examiner* — Gene Kim
*Assistant Examiner* — Alexander R. Niconovich
(74) *Attorney, Agent, or Firm* — Oyen Wiggs Green & Mutala LLP

(57) ABSTRACT

The invention provides a portable bow press and a limb connector therefor, for use with a bow comprising a pair of resilient limbs that extend outwardly from a handle. The bow press is used to force the outer ends of the limbs together, thereby releasing tension on the bow string and/or cable. The user is then able to remove, replace or repair the bow string or cable while the bow press holds the bow in position. The bow press may comprise two limb connectors which hold the bow press in place. Each limb connector may comprise an outer peg and an inner peg, which are used to couple the limb connector to a bow limb.

16 Claims, 3 Drawing Sheets

PORTABLE BOW PRESS AND LIMB CONNECTOR THEREFOR

TECHNICAL FIELD

This invention relates generally to bows used in the sport of archery, and more particularly to bow presses which assist users in drawing the outer ends of bow limbs together to relieve tension on the bow string and cable.

BACKGROUND

Compound bows and compound crossbows all have limbs extending out from a central handle. The limbs of compound bows are typically stiffer than the limbs of non-compound bows, which translates into greater elastic potential energy per displacement, and greater accuracy and velocity. In order to facilitate the drawing of a compound bow by the user, at least one cam and/or pulley is provided.

The string in a compound bow is usually maintained under tension, even when the bow is not drawn. This tension, combined with the stiffness in the limbs, makes it very difficult for the user to remove and replace the bow string or cable without the use of a bow press to controllably force the outer ends of the limbs together.

The inventor has identified a need for portable bow presses which are easy to use and do not require the user to be strong.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a limb connector comprising a base having an outer peg and an inner peg extending therefrom. The outer peg is configured to abut a front side of the limb at a first location near an end thereof, and the inner peg is configured to abut a back side of the limb at a second location inward of the first location.

Another aspect of the invention provides a bow press for a bow comprising a pair of limbs extending outwardly in opposite directions from a central portion of the bow. The bow press comprises a pair of limb connectors for coupling to the pair of limbs. Each limb connector comprises a base having an outer peg and an inner peg extending transversely therefrom and an attachment portion extending outwardly from the base. The outer peg is configured to abut a front side of the limb at a first location near an end thereof and the inner peg is configured to abut a back side of the limb at a second location inward of the first location. The attachment portion is configured to extend beyond an end of the limb when the limb connector is coupled to the limb. A tensioning mechanism is coupled between the attachment portions of the limb connectors. The tensioning mechanism is moveable between an extended position and a contracted position.

Further aspects and details of specific embodiments are set out below.

BRIEF DESCRIPTION OF DRAWINGS

In drawings which illustrate non-limiting embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
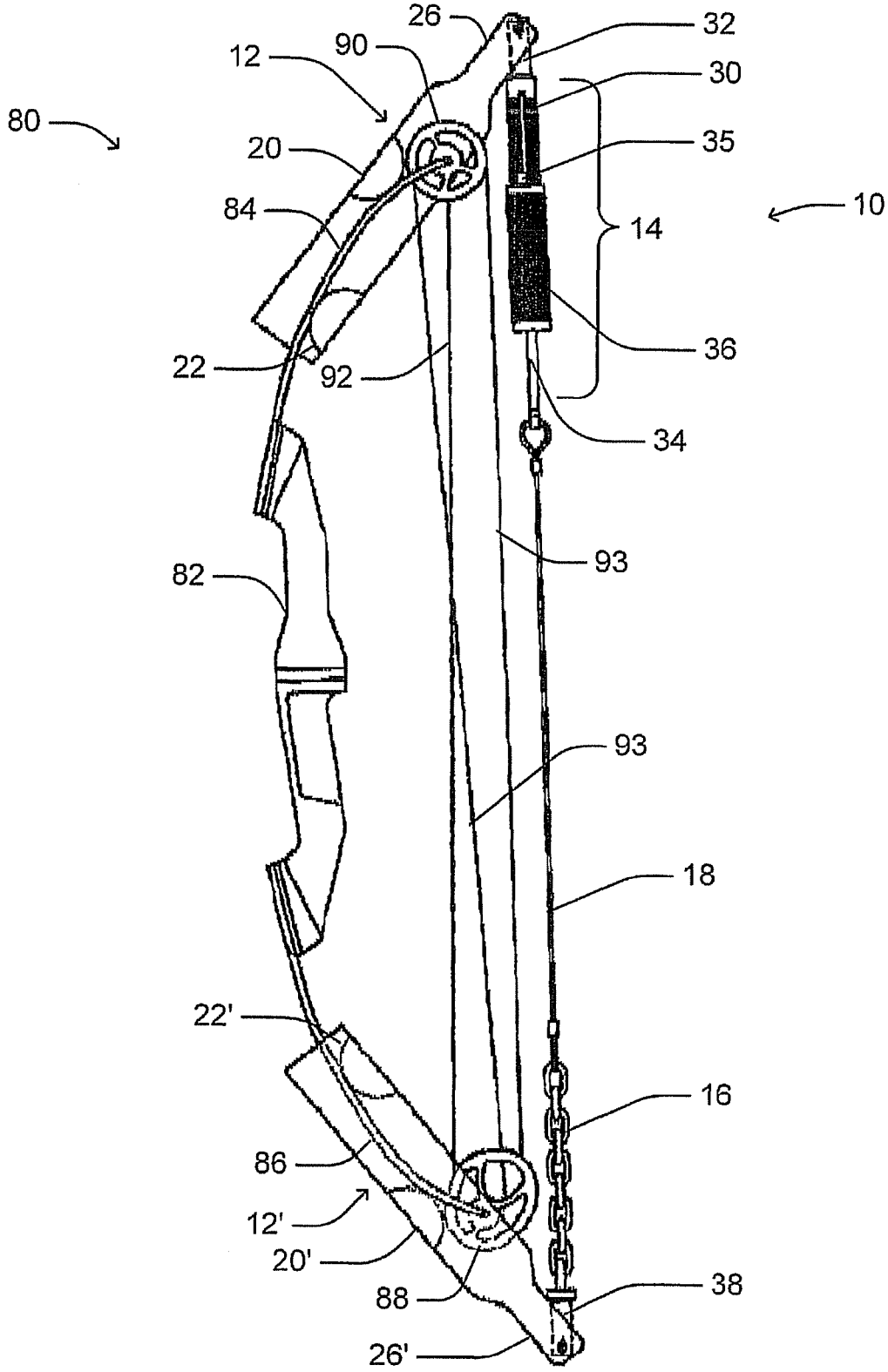
FIG. 1 shows a portable bow press applied to a bow, with the bow press in an extended position and the bow in a neutral position.

FIG. 1 shows a portable bow press 10 coupled to a bow 80 according to an example embodiment of the invention. The central portion of bow 80 comprises a handle 82 and limbs 84 and 86 extending outwardly therefrom. The terms "outward" and "inward" (and variations thereof) are used herein to respectively refer to directions away from and toward handle 82. Also, the terms "forward" and "backward" (and variations thereof) are used herein to respectively refer to directions along and opposite to the direction of travel of an arrow fired from bow 80.

In the embodiment shown in FIG. 1, bow 80 is a single cam compound bow. However, it is to be understood that the invention may be used with a variety of bows, including most types of compound bows, crossbows, or any other bow in situations where a user desires assistance in releasing tension on the bowstring.

Bow 80 comprises a cam 88 rotatably mounted at the outer end of limb 86 and a pulley 90 rotatably mounted at the outer end of limb 84. A cable 92 is attached to a mounting point at the axle of pulley 90, wound around an outer sheave defined in peripheral portions of cam 88, and attached to another mounting point along the outer sheave of cam 88. A bowstring 93 is attached to a mounting point along the outer sheave of cam 88, wound around a sheave defined in pulley 90, wound back around an inner sheave defined in cam 88, and attached to another mounting point along the inner sheave of cam 88.

Figure 2:
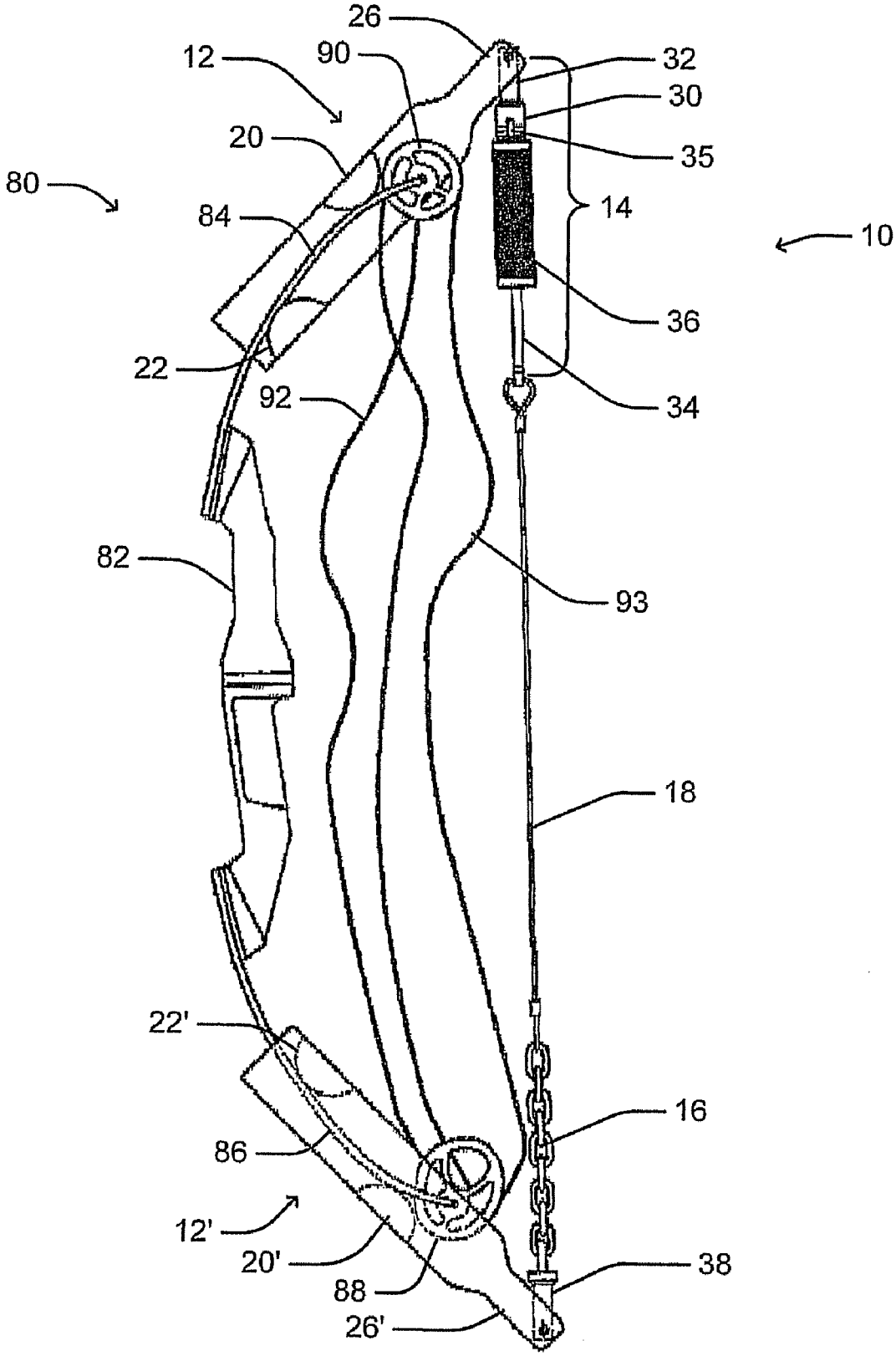
FIG. 2 shows the bow press of FIG. 1 in a contracted position and the bow in a tensioned position in which the limbs of the bow have been drawn together; and, FIG. 3 shows an exploded view of the bow press of FIG. 1.

Bow press 10 may be coupled between limbs 84 and 86 of bow 80 to facilitate removal, adjustment and/or replacement of cable 92 and bowstring 93. Bow press 10 is movable between an extended position wherein bow 80 remains in a neutral position (as shown in FIG. 1), and a contracted position wherein limbs 84 and 86 of bow 80 are pulled together into a tensioned position (as shown in FIG. 2), such that the tension on cable 92 and bowstring 93 is relieved.

Bow press 10 is coupled to limbs 84 and 86 of bow 80 by limb connectors 12 and 12', respectively. As discussed further below, limb connectors 12 and 12' are configured to be easily and quickly coupled and uncoupled to limbs 84 and 86. Limb connectors 12 and 12' may be of substantially similar construction, or may be mirror images, but this is not necessary in all embodiments.

In the illustrated embodiment, limb connectors 12 and 12' extend beyond the ends of limbs 84 and 86. This allows bow press 10 to be clear of cam 88, pulley 90, cable 92 and bowstring 93 when coupled to bow 80. The extension of the outer ends of limb connectors 12 and 12' beyond the ends of limbs 84 and 86 also provides a mechanical advantage to bow press 10 when compared to prior art bow presses which are coupled at or near the ends of a bow's limbs, resulting from the increased lengths of lever arms provided by limb connectors 12 and 12'.

In the illustrated embodiment, bow press 10 comprises a tensioning mechanism 14 coupled to limb connector 12, a chain 16 coupled to limb connector 12', and a cable 18 coupled between tensioning mechanism 14 and chain 16. Bow press 10 may be used with different sizes of bows by connecting different links of chain 16 to limb connector 12'. In other embodiments, the arrangement of tensioning mechanism 14, chain 16 and cable 18 may be different. For example, tensioning mechanism 14 could be coupled between chain 16 and cable 18, or chain 16 and/or cable 18 could be omitted or replaced with other elongated elements such as wires, straps or the like. All that is necessary is that some mechanism is provided for coupling tensioning mechanism 14 between limb connectors 12 and 12'.

Figure 3:
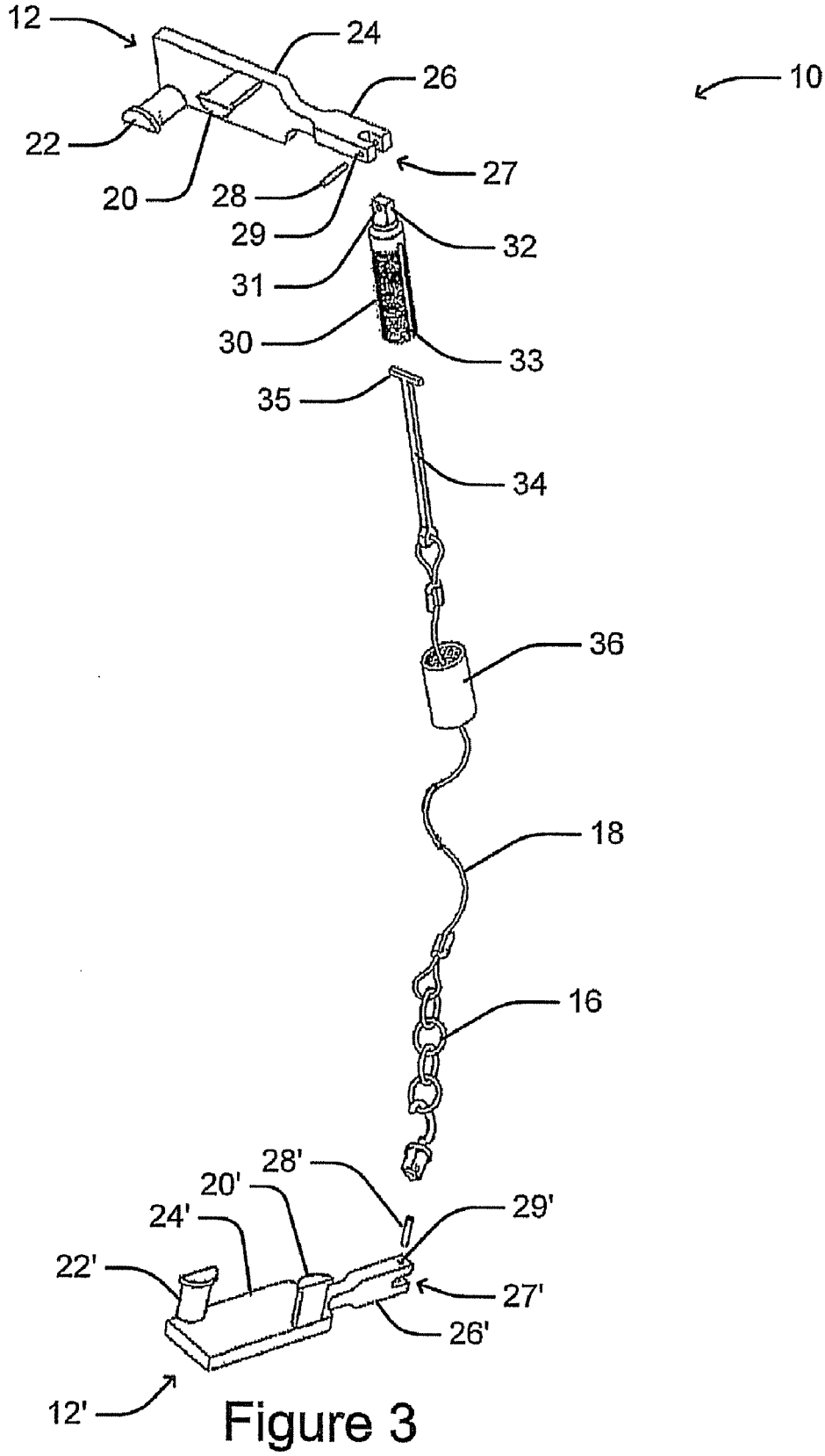

FIG. 3 shows an exploded view of bow press 10. Limb connector 12 comprises an outer peg 20 and an inner peg 22 extending transversely from a base 24. Outer peg 20 and inner peg 22 are positioned on opposite edges of base 24, such that outer peg 20 may be positioned on the front side of limb 84 and inner peg 22 may be positioned on the back side of limb 84, as shown in FIGS. 1 and 2. Likewise, limb connector 12' comprises an outer peg 20' and an inner peg 22' extending transversely from opposite edges of a base 24'.

Either or both of pegs 20 and 22 (as well as 20' and 22') may comprise a flange (not specifically enumerated) at the ends thereof opposite base 24 (24'). In some embodiments, a distance between the flanges of pegs 20, 22 (20', 22') and base 24 (24') is selected to be at least equal to a width of limb 84 (86). Pegs 20 and 22 (20' and 22') may comprise rounded portions on the sides thereof which abut limb 84 (86). Pegs 20 and 22 (20' and 22') may also have other shapes.

Attachment portions 26 and 26' extend outwardly from bases 24 and 24' for coupling limb connectors 12 and 12' to tensioning mechanism 14 and chain 16, respectively. Attachment portions 26 and 26' may define notches 27 and 27' sized to receive corresponding attachment features coupled to tensioning mechanism 14 and chain 16, respectively, as described below. Pins 28 and 28' may be provided which fit through apertures 29 and 29' to retain the corresponding attachment features within notches 27 and 27'.

In some embodiments, attachment portions 26 and 26' are integrally formed with bases 24 and 24'. In other embodiments, attachment portions 26 and 26' may comprise separate elements which are securely attached to bases 24 and 24'. Likewise, pegs 20, 20', 22 and 22' may be integrally formed with their respective bases 24 and 24' or securely attached thereto.

Tensioning mechanism 14 comprises a threaded shaft 30 having an attachment feature 32 at one end thereof. Attachment feature 32 defines an aperture 31 therein sized to receive pin 28 to retain attachment feature 32 within notch 27 of limb connector 12. In the illustrated embodiment, attachment feature 32 comprises a pair of generally parallel sides which fit inside notch 27, such that threaded shaft 30 may not be rotated about its longitudinal axis, but can still pivot about pin 28. Threaded shaft 30 defines a slot 33 therein. Slot 33 extends from an end of threaded shaft 30 opposite attachment feature 32 longitudinally into threaded shaft 30. In some embodiments, slot 33 may extend slightly farther than a threaded portion of threaded shaft 30.

An anchor member 34 is slidably received in slot 33. Anchor member 34 comprises a protruding portion 35 which protrudes out the sides of slot 33, such that anchor member 34 may be retained in slot 33 when a threaded collar 36 is screwed onto threaded shaft 30. Rotation of threaded collar 36 about threaded shaft 30 in one sense causes anchor member 34 to move toward attachment feature 32, which in turn moves bow press 10 toward the contracted position. Conversely, rotation of threaded collar 36 about threaded shaft 30 in an opposite sense allows anchor member 34 to move away from attachment feature 32, which in turn moves bow press 10 toward the extended position. In some embodiments, threaded collar 36 may be partially screwed onto threaded shaft 30 in the extended position.

One end of cable 18 is attached to anchor member 34 at an end thereof opposite protruding portion 35. The other end of cable 18 is attached to one end of chain 16. Chain 16 comprises a plurality of links, one of which may be engaged by a hook 37 attached to or integrally formed with an attachment feature 38. Attachment feature 38 defines an aperture 39 therein sized to receive pin 28' to retain attachment feature 38 withing notch 27' of limb connector 12'.

In operation, when bow 80 is in the neutral position, limb connector 12 is placed over limb 84 so that outward end of limb 84 is held between outer peg 20 and inner peg 22. Similarly, limb connector 12' is placed over limb 86 so that outward end of limb 86 is held between outer peg 20' and inner peg 22'. In some embodiments, outer peg 20 rests against both limb 84 and pulley 90, and outer peg 20' rests against both limb 86 and cam 88. As one skilled in the art will appreciate, limb connectors 12 and 12' may be easily and rapidly fitted over limbs 84 and 86, due to the open space between outer pegs 20 and 20' and inner pegs 22 and 22'.

Once limb connectors 12 and 12' are in place, the user then engages one of the links of chain 16 with hook 37. Alternatively, the user may engage one of the links of chain 16 with hook 37 prior to placing the limb connectors 12 and 12' over the ends of limbs 84 and 86. The user will typically select the link of chain 16 which leaves the least amount of slack in chain 16 and cable 18 when bow press 10 is in the extended position.

The user then moves bow press 10 into the contracted position by screwing threaded collar 36 onto threaded shaft 30, thereby forcing anchor member 34 toward attachment feature 32. This in turn forces limbs 84 and 86 together, moving bow 80 into the tensioned position shown in FIG. 2 and releasing the tension on cable 92 and bowstring 93. The user may then adjust, remove and/or replace cable 92 or bowstring 93, and then reverse the steps set out above to return bow 80 to the neutral position.

While a number of exemplary aspects and embodiments have been discussed above, those of skill in the art will recognize certain modifications, permutations, additions and sub-combinations thereof. For example:

- Instead of having notches 27 and 27', pins 28 and 28' and apertures 29 and 29', attachment portions 26 and 26' of limb connectors 12 and 12' could be provided with other mechanisms for coupling tensioning mechanism 14 (and possibly chain 16 and/or cable 18) therebetween.
- Tensioning mechanism 14 may have a different structure than that of the example embodiment discussed above. Some examples of such different structures are disclosed in U.S. Pat. No. 6,957,647 to Evans et al., which is hereby incorporated by reference herein.

It is therefore intended that the following appended claims and claims hereafter introduced are interpreted to include all such modifications, permutations, additions and sub-combinations as are within their true spirit and scope.

What is claimed is:

1. A bow press for a bow comprising a pair of limbs extending outwardly in opposite directions from a central portion of the bow, the bow press comprising:

a pair of limb connectors for coupling to the pair of limbs, each limb connector consisting essentially of a base having a front face configured to face or abut a right or left side of a limb and having an outer peg and an inner peg extending transversely therefrom, the outer peg configured to abut a front side of the limb at a first location near an end thereof and the inner peg configured to abut a back side of the limb at a second location inward of the first location, and an attachment portion extending outwardly from the base, the attachment portion configured to extend beyond an end of the limb when the limb connector is coupled to the limb; and, a tensioning mechanism coupled between the attachment portions of the limb connectors, the tensioning mechanism moveable between an extended position and a contracted position.

2. A bow press according to claim 1 wherein at least one of the limb connectors comprises a flange on at least one of the outer and inner pegs on an end thereof opposite the base.

3. A bow press according to claim 2 wherein a distance between the flange and the base is at least equal to a width of the limb.

4. A bow press according to claim 1 wherein the tensioning mechanism comprises:

a threaded shaft coupled to one of the limb connectors, the threaded shaft having a first end and a second end, and defining a slot extending longitudinally into the threaded shaft from the second end thereof and extending transversely through the threaded shaft on at least one side;

an anchor member coupled to the other limb connector, the anchor member configured to be slidably received in the slot of the threaded shaft, the anchor member comprising a protruding portion at one end thereof configured to protrude transversely out of the slot; and, a threaded collar configured to threadedly engage the threaded shaft and to abut the protruding portion of the anchor member when the threaded collar engages the threaded shaft, whereby rotation of the threaded collar in one sense forces the anchor member to move toward the first end of the threaded shaft, and rotation of the threaded collar in an opposite sense allows the anchor member to move away from the first end of the threaded shaft.

5. A bow press according to claim 4 wherein the threaded shaft is coupled to the one limb connector by an attachment feature on the first end thereof for attaching to the attachment portion of the one limb connector.

6. A bow press according to claim 5 wherein the anchor member is coupled to the other limb connector by a cable attached to an end thereof opposite the protruding portion, a chain attached to the cable, and a hook having an attachment feature thereon for attaching to the attachment portion of the other limb connector, the hook configured for selective engagement with one of a plurality of links of the chain.

7. A bow press according to claim 4 wherein the threaded shaft is non-rotationally coupled to the one limb connector.

8. A bow press according to claim 5 wherein the attachment feature on the first end of the threaded shaft has a pair of generally parallel sides and defines an aperture therethrough, and the attachment feature on the one limb connector comprises a notch sized to receive the pair of generally parallel sides and a pin extending through the aperture, such that the threaded shaft is prevented from rotating about its longitudinal axis and is permitted to pivot about the pin.

9. A bow press according to claim 1 wherein at least one of the outer and inner pegs of at least one of the limb connections has a rounded portion on a side thereof configured to abut the limb.

10. A bow press according to claim 1 wherein the base, inner peg and outer peg of each limb connector are integrally formed.

11. A bow press for a bow comprising a pair of limbs extending outwardly in opposite directions from a central portion of the bow, the bow press comprising:

a pair of limb connectors for coupling to the pair of limbs, each limb connector comprising a base having a front face configured to face or abut a right or left side of a limb and having an outer peg and an inner peg extending transversely therefrom, the outer peg configured to abut a front side of the limb at a first location near an end thereof and the inner peg configured to abut a back side of the limb at a second location inward of the first location, and an attachment portion extending outwardly from the base, the attachment portion configured to extend beyond an end of the limb when the limb connector is coupled to the limb, and wherein an open space is defined between the outer peg and the inner peg such that the limb connector does not impede movement of the limb in a direction that is generally perpendicular to a longitudinal direction of the limb, generally perpendicular to a forward direction of the bow, and away from the base; and, a tensioning mechanism coupled between the attachment portions of the limb connectors, the tensioning mechanism moveable between an extended position and a contracted position.

12. A bow press according to claim 11 wherein the base, inner peg and outer peg of each limb connector are integrally formed.

13. A bow press according to claim 11 wherein the tensioning mechanism comprises:

a threaded shaft coupled to one of the limb connectors, the threaded shaft having a first end and a second end, and defining a slot extending longitudinally into the threaded shaft from the second end thereof and extending transversely through the threaded shaft on at least one side;

an anchor member coupled to the other limb connector, the anchor member configured to be slidably received in the slot of the threaded shaft, the anchor member comprising a protruding portion at one end thereof configured to protrude transversely out of the slot; and, a threaded collar configured to engage the threaded sleeve and to abut the protruding portion of the anchor member when the threaded collar engages the threaded shaft, whereby rotation of the threaded collar in one sense forces the anchor member to move toward the first end of the threaded shaft, and rotation of the threaded collar in an opposite sense allows the anchor member to move away from the first end of the threaded shaft.

14. A bow press for a bow comprising a pair of limbs extending outwardly in opposite directions from a central portion of the bow, the bow press comprising:

a pair of limb connectors for coupling to the pair of limbs, each limb connector comprising a base having a front face configured to face or abut a right or left side of a limb and having an outer peg and an inner peg extending transversely therefrom, the outer peg configured to abut a front side of the limb at a first location near an end thereof and the inner peg configured to abut a back side of the limb at a second location inward of the first location, and an attachment portion extending outwardly from the base, the attachment portion configured to extend beyond an end of the limb when the limb connector is coupled to the limb, and wherein an open space is defined between the outer peg and the inner peg to facilitate rapid attachment of the limb connectors to the limbs without assembly or disassembly of the limb connector or bow; and, a tensioning mechanism coupled between the attachment portions of the limb connectors, the tensioning mechanism moveable between an extended position and a contracted position.

15. A bow press according to claim 14 wherein the base, inner peg and outer peg of each limb connector are integrally formed.

16. A bow press according to claim 14 wherein the tensioning mechanism comprises:

a threaded shaft coupled to one of the limb connectors, the threaded shaft having a first end and a second end, and defining a slot extending longitudinally into the threaded shaft from the second end thereof and extending transversely through the threaded shaft on at least one side;

an anchor member coupled to the other limb connector, the anchor member configured to be slidably received in the slot of the threaded shaft, the anchor member comprising a protruding portion at one end thereof configured to protrude transversely out of the slot; and, a threaded collar configured to engage the threaded sleeve and to abut the protruding portion of the anchor member when the threaded collar engages the threaded shaft, whereby rotation of the threaded collar in one sense forces the anchor member to move toward the first end of the threaded shaft, and rotation of the threaded collar in an opposite sense allows the anchor member to move away from the first end of the threaded shaft.

* * * * *